US007427711B2

(12) United States Patent
O'Modhrain et al.

(10) Patent No.: US 7,427,711 B2
(45) Date of Patent: Sep. 23, 2008

(54) PARTICLE BASED TOUCH INTERACTION FOR THE CREATION OF MEDIA STREAMS

(76) Inventors: Maura Sile O'Modhrain, 35 Adelaide Square, Whitefriar Street, Dublin 8 (IE); Georg Essl, Wörtherstrasse 35a, 10435 Berlin (DE)

( * ) Notice: Subject to any disclaimer, the term of this patent is extended or adjusted under 35 U.S.C. 154(b) by 0 days.

(21) Appl. No.: 11/205,824

(22) Filed: Aug. 17, 2005

(65) Prior Publication Data

US 2005/0252364 A1 Nov. 17, 2005

Related U.S. Application Data

(60) Provisional application No. 60/603,022, filed on Aug. 19, 2004.

(51) Int. Cl.
*G10D 13/08* (2006.01)

(52) U.S. Cl. ..... 84/742; 84/402; 84/723; 84/730; 84/737

(58) Field of Classification Search ..... 84/402, 84/742, 737, 723, 730
See application file for complete search history.

(56) References Cited

U.S. PATENT DOCUMENTS

| | | | | |
|---|---|---|---|---|
| 3,704,339 | A * | 11/1972 | Niinomi | 84/687 |
| 4,681,012 | A * | 7/1987 | Stelma et al. | 84/422.4 |
| 5,005,460 | A * | 4/1991 | Suzuki et al. | 84/600 |
| 5,323,678 | A * | 6/1994 | Yould | 84/418 |
| 5,338,891 | A * | 8/1994 | Masubuchi et al. | 84/600 |
| 7,045,695 | B1 * | 5/2006 | Cohen | 84/402 |
| 7,045,697 | B2 * | 5/2006 | Covello et al. | 84/418 |
| 2003/0066412 | A1 * | 4/2003 | Nishitani et al. | 84/609 |
| 2003/0230186 | A1 * | 12/2003 | Ishida et al. | 84/737 |

* cited by examiner

*Primary Examiner*—Lincoln Donovan
*Assistant Examiner*—David S. Warren
(74) *Attorney, Agent, or Firm*—Charles G. Call

(57) ABSTRACT

Methods and apparatus for manipulating physical objects to produce sounds that are correlated with the feel of the objects being manipulated. Example devices called the PebbleBox, CrumbleBag and ScrubberGlove each use the manipulation of physical objects of arbitrary material as the basis for interacting with granular sound synthesis models. The sounds made by the objects as they are manipulated produce sound signal events that are detected and used to trigger and control the reproduction of stored sound samples in real time.

20 Claims, 4 Drawing Sheets

PARTICLE BASED TOUCH INTERACTION FOR THE CREATION OF MEDIA STREAMS

CROSS REFERENCE TO RELATED APPLICATION

This application is a Non-Provisional of, and claims the benefit of the filing date of, U.S. Provisional Patent Application Ser. No. 60/603,022 filed Aug. 19, 2004, the disclosure of which is incorporated herein by reference.

FIELD OF THE INVENTION

This invention relates to audio signal generation systems and more particularly to systems for producing audio signals representative of physical events.

BACKGROUND OF THE INVENTION

Interaction with objects in the world around us is a richly multisensory experience. Casting a pebble into a pond, we both see the ripples resulting from the disturbance of the water's surface and hear the impact of the stone on the water as a disturbance of the air. If we are close enough and the stone is big enough, we might also get wet. Furthermore, the interaction of stone and water makes certain information explicit: the size of the splash is correlated with both the size of the stone and the force with which it was thrown, and the sound it makes provides information about the depth of the water. Thus the physical laws that govern the behavior of stones falling into water give rise to an event which is perceived via many sensory channels which each encode, in their different ways the complexity of the event. The perceptual system therefore has a number of representations of the event upon which to draw.

In the detailed description that follows, we describe a methodology for sound control based on the commonalities between the behavior of physical objects and that of sound objects which share many of their physical properties, and describe three exemplary embodiments of this methodology.

In the course of the description that follows, selected publications will be cited using the notation {Ref. nn} where "nn" refers to the numbered citation in the list of references which appears below.

REFERENCES

{Ref. 1} P. R. Cook. Physically Informed Sonic Modeling (PhISM): Synthesis of Percussive Sounds. Computer Music Journal, 21(3):38-49, 1997.

{Ref. 2} P. R. Cook. Toward Physically-Informed Parametric Synthesis of Sound Effects. In Proceedings of the 1999 IEEE Workshop on Applications of Signal Processing to Audio and Acoustics (WASPAA-99), pages 1-5, New Paltz, N.Y., Oct. 17-20, 1999.

{Ref. 3} P. R. Cook. Real Sound Synthesis for Interactive Applications, chapter 13, pages 149-168. A K Peters, Ltd., 2002.

{Ref. 4} S. Ebersole. CSU-Pueblo Television Production Handbook. Retrieved online on Jan. 24, 2004 at http://faculty.colostate-pueblo.edu/samuel.ebersole/handbook/sfx.html.

{Ref. 5} A. Eremenko and D. Novikov. Oscillation of Fourier Integrals with a spectral gap. Retrieved online on Jan. 20, 2004 at http://www.math.purdue.edu/~eremenko/dvi/novik1011.pdf, May 30, 2003.

{Ref. 6} Federation of American Scientists. Tempest. Retrieved online on Jan. 26, 2004 at http://www.fas.org/irp/program/security/tempest.htm.

{Ref. 7} A. Gadd and S. Fels. MetaMuse: A Novel Control Metaphor for Granular Synthesis. In Proceedings ACM Conference on Computer Human Interaction. SigCHI, ACM, 2002.

{Ref. 8} A. Hunt, M. M. Wanderley, and M. Paradis. The importance of parameter mapping in electronic instrument design. In Proceedings of the 2002 Conference on New Instruments for Musical Expression (NIME-02), pages 149-154, Dublin, Ireland, May 24-26, 2002.

{Ref. 9} A. Hunt, M. M. Wanderley, and K. R. Towards a Model for Instrumental Mapping in Expert Musical Interaction. In Proceedings of the International Computer Music Conference (ICMC-00), pages 209-212, Berlin, Germany, Aug. 27-Sep. 1, 2000.

{Ref. 10} T. Jehan, T. Machover, and M. Fabio. Sparkler: An audio-driven interactive live computer performance for symphony orchestra. In Proceedings of the International Computer Music Conference, GÄoteborg, Sweden, Sep. 16-21, 2002.

{Ref. 11} T. Jehan. Perceptual Synthesis Engine: An Audio-Driven Timbre Generator, Masters thesis, Massachusetts Institute of Technology, September 2001.

{Ref. 12} D. Keller and J. Berger. Everyday sounds: synthesis parameters and perceptual correlates. In Proceedings of the VIII Brazilian Symposium of Computer Music, Fortaleza, Brazila, 2001.

{Ref. 13} C. Lippe. Real-time granular sampling using the ircam signal processing workstation. Contemporary Music Review, 10:149-155, 1994.

{Ref. 14} S. O'Modhrain. Playing by Feel: Incorporating Haptic Feedback into Computer-Based Musical Instruments. PhD thesis, Stanford University, Palo Alto, Calif., November 2000.

{Ref. 15} T. Opie. Granular synthesis: Experiments in live performance. In Proceedings of the Australasian Computer Music Conference 2002, pages 97-102, Fitzroy, Australia, 2002.

{Ref. 16} T. Opie. Creation of a real-time granular synthesis instrument for live performance. Master's thesis, QUT, Brisbane, Australia, 2003.

{Ref. 17} C. Panagiotakis and G. Tziritas. A Speech/Music Discriminator Based on RMS and Zero-Crossings. Retrieved online on Jan. 20, 2004 at http://www.cs-d.uch.gr/~tziritas/papers/sound_seg_class_00.pdf, 2004.

{Ref. 18} J. Paradiso. Electronic Music Interfaces: New Ways to Play. IEEE Spectrum Magazine, 34(12):18{30, Dec. 1997. Available online at http://www.spectrum.ieee.org/select/1297/muse.html.

{Ref. 19} G. Peeters and X. Rodet. Automatically selecting signal descriptors for Sound Classification. In Proceedings of the International Computer Music Conference, pages 455-458, GÄoteborg, Sweden, Sep. 16-21, 2002.

{Ref. 20} M. S. Puckette. Theory and Technques of Electronic Music. Retrieved online on Jan. 22, 2004 at http://crca.ucsd.edu/~msp/techniques/latest/book.pdf, Dec. 8, 2003.

{Ref. 21} C. Roads. Microsound. MIT Press, Cambridge, Mass., 2001.

{Ref. 22} D. Rocchesso and F. Fontana, editors. The Sounding Object. PHASAR Srl, Florence, Italy, 2003. Available online at http://www.soundobject.org/SObBook/SObBook_JUL03.pdf.

{Ref. 23} J. B. Rovan, M. M. Wanderley, S. Dubnov, and P. Depalle. Instrumental Gestural Mapping Strategies as Expressivity Determinants in Computer Music Performance. In Proceedings of Kansei—The Technology of Emotion Workshop, Genova, Italy, Oct. 3-4, 1997. Available online at http://www.ircam.fr/equipes/analyse-synthese/wanderle/Gestes/Externe/ka%nsei_final.pdf.

{Ref. 24} D. Trueman. The lobster quadrille. available online at http://www.xs4all.nl/~mwais/confusioninfo.html, 1999.

{Ref. 25} D. Trueman and P. R. Cook. BoSSA: The Deconstructed Violin Reconstructed. In Proceedings of the International Computer Music Conference, pages 232-239, Beijing, China, Oct. 22-27, 1999.

{Ref. 26} W. H. Warren and R. R. Verbrugge. Auditory Perception of Breaking and Bouncing Events: A Case Study in Ecological Acoustics. Journal of Experimental Psychology, 10(5):704-712, 1984.

{Ref. 27} G. Weinberg. Expressive Digital Musical Instruments For Children. Master's thesis, MIT Media Laboratory, Cambridge, Mass., 1999.

{Ref. 28} G. Weinberg. The Musical Playpen: An Immersive Digital Musical Instrument. Personal Technologies, 3:132-136, 1999.

Complex sounds can be thought of as a series of short, discrete bursts of energy, called "grains," each slightly changed in character from the last. Within a very short time window (10-21 milliseconds (msec)) the ear is capable of registering an event at a specific frequency. This property of sound makes it possible for the now familiar digital audio formats to store and reproduce sound as a series of discrete samples. Granular synthesis of sound is the generation of thousands of short sonic grains which are combined linearly to form large scale audio events. The characteristics of the grains are definable, and these combine to give the characteristics of the overall sound.

Granular synthesis has been used in live computer music performances including novel interfaces for expressive control of granulated sound. For example, in "The Lobster Quadrille" {Ref. 24}, Dan Trueman used his sensor-augmented violin bow, (the RBow {Ref. 25}), to play granular models. Additionally a number of controllers related to granular synthesis have been proposed. These include Timothy Opie's Fish {Refs. 15, 16} Gadd and Fels' MetaMUSE {Ref. 7}, Perry Cook's PhISM and FoleyMat controllers {Refs. 2, 3} and the MIDI key-board and laptop based Creatovox by Roads {Ref. 21}. Cook also proposed a granular approach to Gait synthesis {Ref. 3} which is also related to other footware controllers {Ref. 18}. While all of these controllers drive granular synthesis, and have some haptic feel to them, they usually do not retain the haptic component of the granular interaction itself. For example, Cook's PhISM shakers retain the form factor and weight of an acoustic shaker, but the moving particles (pebbles or the like) are removed and replaced by rigidly anchored electronics. Hence the performer does not feel the particle inter-action—they feel the coarse haptic experience but not the fine detail. This also holds for Gadd and Fels' MetaMUSE {Ref. 7} and the RBow {Ref. 25}. In the case of the Opie and Road's controllers, the control gesture is abstracted from the interaction and neither level is captured directly.

It is desirable to retain the haptic features that are relevant for the parametric control of the sound synthesis algorithm, a goal that has not been explicitly stated elsewhere in the literature. While musical devices that have implicit haptic components have been explored elsewhere. For example, the Musical Playpen and Musical Candy Bowl of Weinberg and coworkers {Refs. 28, 27} employed spatially distributed accelerometers, these were not used for tight musical coupling or control of event-based granular synthesis.

SUMMARY OF THE INVENTION

The preferred embodiments of the invention process sounds produced by manipulating one or more physical objects that can be felt by touch by a human manipulator. An acoustic transducer converts the sounds produced by manipulating the objects into an electrical signal, which is then analyzed to identify signal events that may be individually perceived by the human ear. The signal analysis produces an event signal that indicates the timing, magnitude and spectral content of each event. A controlled signal generator is then used to produce a composite output sound signal which includes a copy of a recorded sound segment corresponding to each sound signal event, the copy having an intensity and a time of occurrence that corresponds to the amplitude and relative timing of the triggering events, and has a timbre corresponding to the spectral content of the detected sound event.

The preferred embodiments include a variety of physical objects that can be felt as they are manipulated to generate sounds. A first embodiment, called the "PebbleBox" consists of a container that holds an aggregation of rigid bodies like pebbles, steel balls, marbles, etc. and that is fitted with a microphone that captures sounds made when the objects strike one another as they are manipulated. A second embodiment, called the "CrumbleBag," uses a flexible pouch that holds a material, such as cornflakes, that emits sounds as the bag is deformed. A microphone is attached to the pouch, and the contents of the pouch may be removed and replaced with a different material that produces a different sound when the pouch is manipulated. A third embodiment, called the "ScrubberGlove," is a glove with a textured outer surface and cutaway fingertips to permit objects which are being held by the glove to be more easily felt by the wearer. As the glove contacts objects being felt and manipulated, the textured glove surface produces sound signals that are processed by the signal analyzer.

The signal analyzer preferably employs the combination of a threshold device for determining when the input sound signal emitted by the objects being manipulated rises to a maximum above a predetermined threshold. Signal maximum values above the threshold are detected as used as a measure of event intensity. A mechanism such as a zero crossing detector is used to extract an estimate of the spectral content of the sound emitted by the objects. The timing, amplitude and spectral content values formed for each signal event are then used to trigger the timing of, and control the intensity and timbre of, a recorded sound signal segment that is delivered to a sound system for reproduction.

BRIEF DESCRIPTION OF THE DRAWINGS

In the detailed description which follows, frequent reference will be made to the attached drawings, in which.

DETAILED DESCRIPTION

Goals

Figure 1:
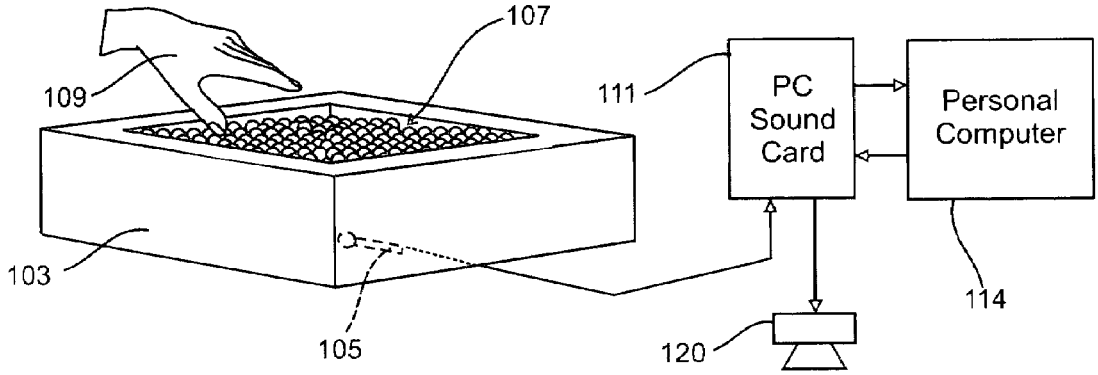
FIG. 1 is an illustration of an embodiment of the invention which produces a sound signal representative of the collisions between granular objects such as pebbles in a container.

An overarching goal of our work on haptic controllers for computer-based musical instruments is to preserve a coupling, however loose, between the haptic and auditory senses and to build on these couplings to develop new paradigms for instrument control. The illustrative embodiments described below represent a sub-set of such controllers, those based on interactions that are mediated by physical objects, the properties they embody and the manipulation strategies they invoke. For more details on experimental investigations into the importance of haptic feedback for musical performance {Ref. 14}.

Since a specific goal was the implementation of a control interface that couples the feel and sound of granular events, it was important to incorporate into the interface the manipulation of elements that could objectively or subjectively give rise to granular sounds. Three different interaction paradigms were developed: playing with a hand full of pebbles, manually crushing a bag of brittle material, and handling an object with a glove that permitted the object to be felt with the fingertips while picking up the sound produced at the roughly textured glove surface contacted the object. All of these methods for manually interacting with physical objects produced complex environmental events whose temporal patterns give rise to important perceptual cues {Refs. 12, 26}.

There is a need for a better way to sense and process these temporal events. This poses a number of problems. First, given the nature of the sounds of interest, the events are likely to be spatially distributed. Moreover, the sound-producing mechanism may be internal to the objects interacted with (e.g. crinkling paper), or may be a result of their destruction (e.g. crushing cornflakes). Finally, while the coupling between temporal events as they are perceived by both the haptic and auditory system should be relatively tight, it is desirable that other parameters, such as the timing, amplitude, and frequency of these events be accessible for further exploration by the performer.

The present invention deals with sounds produced by our actions on objects in the world. Thus dragging, dropping, scraping and crushing give rise to correlated touch and sound events {Ref. 22}. As noted earlier, such events also bear many signatures of other physical characteristics of the materials and actions involved. However, it is possible to imagine a further class of events where the feel of an object and the sound it produces are less strongly correlated. For example, when playing with pebbles in ones hand, the haptic sensation one feels is that of the pebbles against the hand, while the sound of the interaction stems from the colliding of pebbles within the hand. This loose correlation between feel and sound is appropriate for this experience and in its looseness provides an opportunity to decouple the haptic experience from the sound source. This is the opportunity we build on in the granular sound synthesis mechanisms embodying the invention that are described below.

Figure 2:
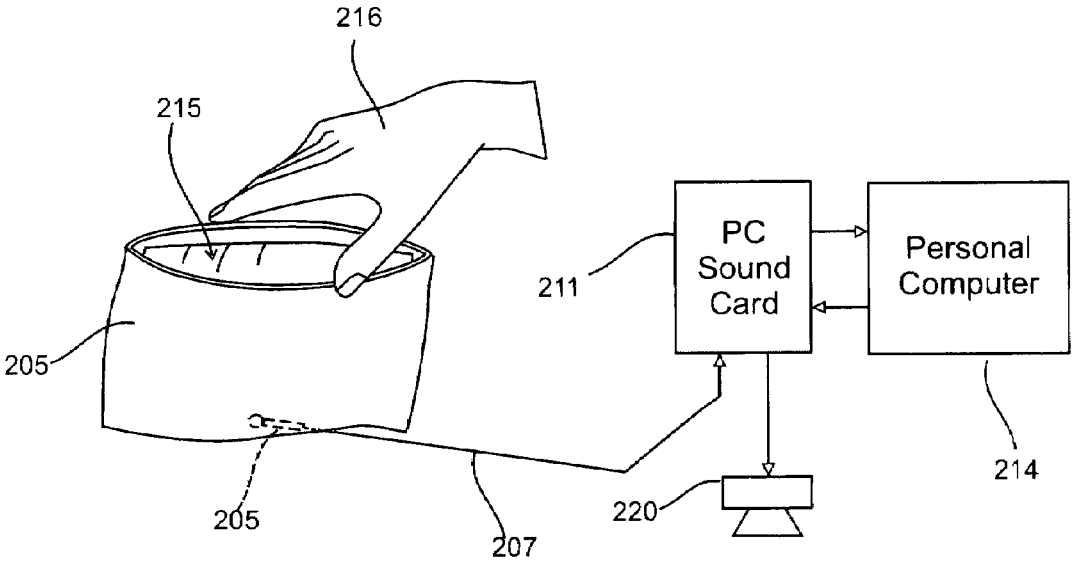
FIG. 2 is an illustration of an embodiment of the invention in which a microphone is placed inside a deformable bag containing a material such as breakfast cereal to capture the sound produced when the bag is compressed or deformed.
Figure 3:
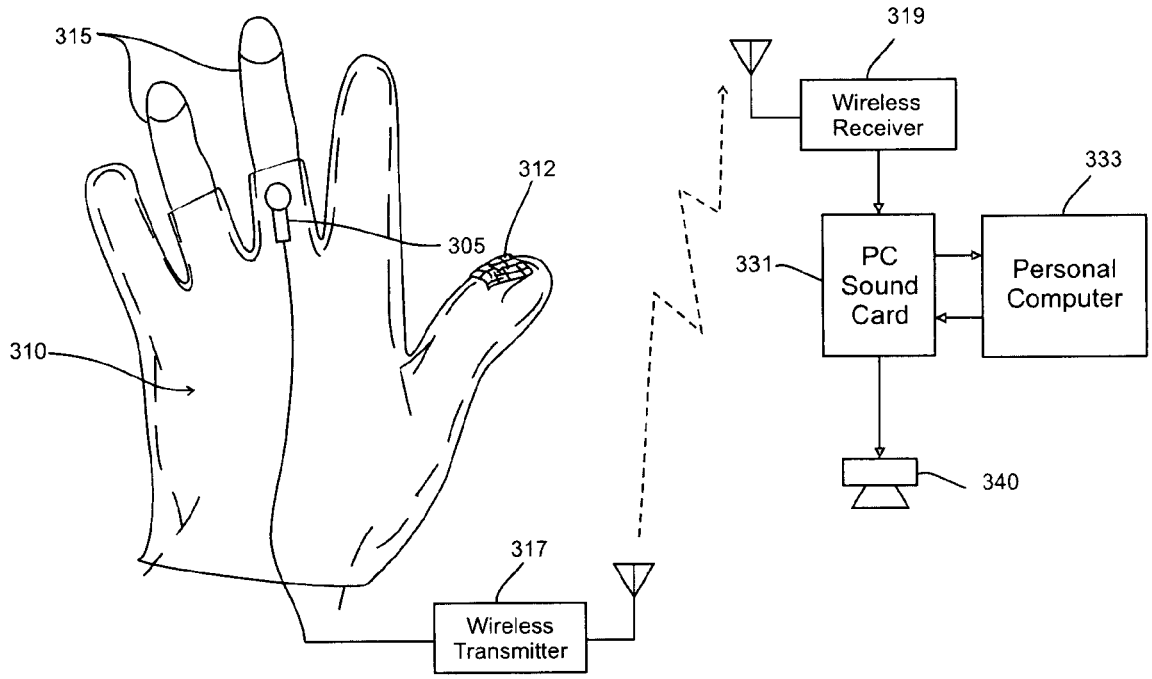
FIG. 3 is an illustration of a third embodiment of the invention in which a pickup microphone is placed in a glove to capture sounds created when the wearer's hand contacts or rubs against an object.

The first example embodiment, which we call "the PebbleBox," is shown in FIG. 1 and is based on the manipulation of objects in the environment; specifically, the manipulation of pebbles or the like in a tray. The second embodiment, called "the CrumbleBag," is shown in FIG. 2 and is based on the manipulation of an ensemble of grains contained in a malleable pouch. The third embodiment, called "the ScrubberGlove," is shown in FIG. 3 and is based on capturing sounds produced when textured material on a glove interact with an object being manipulated and felt by the glove's wearer. Each of these three embodiments of the invention will be summarized individually below, followed by a more detailed description of the sound signal processing method that is used with each to provide desired output sound signals.

The PebbleBox

PebbleBox consists of a container box or tray seen at 103. This can be a wooden chest or a plastic manufactured container. The tray 103 is constructed from, or its interior is lined with, foam to minimize the production of sound that would otherwise be produced when the objects collide with the tray and to damp the sounds of objects dropped or rolled inside the tray. Sounds are produced by interactions and disturbances between the small objects 107 held by the tray as those objects are manipulated by a user's hand 109. These sounds emitted by object collisions are picked up by the microphone 105 imbedded in the bottom at its center. Additionally, the microphone 105 picks up interactions in a limited range above the device; for example, sounds produced by the interaction of objects held in the hand just above the tray 109. The size of the tray is flexible and can range from hand size upward. Our implementation used a wooden chest having the width-length-depth dimensions 19×30×7 cm and its interior walls were padded with foam material of 3 cm thickness. A 3 mm drilled in the center bottom of the chest created a cavity of less than 3 mm height and width in the bottom side of the bottom foam to contain a small active microphone 105. This microphone is connected to a standard sound card 111 in a personal computer 114. The active microphone is powered by 9-12 volt DC power source of a 9V battery (not shown).

The objects 107 that fill the tray 103 should be rigid objects that create impact collision sounds. We used collections of polished rocks of size of length, width and height between 3-8 cm in one collection, 2-5 cm in another and 3-5 mm in the third collection. We also tried smooth glass cubes of 2.5×2.5×2.5 cm size, as well as roughly textured rounded glass triangles of 3-4 cm edge length and 1 cm thickness. In addition, we used flat smooth glass droplets of 2 cm diameter and 5 mm thickness. Typically 25-35 objects were used to fill the tray. All of these object collections provided satisfactory results. Different kinds of objects, such as polished stones, marbles, ball bearings and crumbling paper produce different sounds and tend to induce different kinds of manipulation, such as grabbing, dropping, tapping, crumbling, shuffling, rolling and so forth.

The sound signal picked up by the microphone 105 and passed to the personal computer 114 via the sound card 111 is processed as described below in the section entitled "Grainification." After processing, the resulting signal is used to create an output sound signal supplied to a loudspeaker 120.

The CrumbleBag

The CrumbleBag consists of a deformable bag container seen at 203. The bag or pouch 203 can be made of any suitable flexible material, such as rubber or leather. Our implementation uses a rubber sheet of 22×30 cm and about 1.5 mm thickness folded over and sown together at the sides to form a 22×15 cm bag with an opening along one of the long edges. A layer of felt lines the inside of the bag, and a microphone 205 is placed inside the bag and connected to a sound card 211 by connection cable 207 escaping through one side of the bag. The microphone 205 is connected to the sound card 211 in a personal computer 214 and is powered by 9-12 volt DC power source or a 9V battery (not shown).

The filling material may be contained in a cloth or a plastic bag as indicated at 215 of dimensions around 20×14 cm that can be placed inside the pouch 203. In this way, different filling materials may be interchanged using the same microphone-equipped pouch. The filling material can be any material that creates sound when pressed through deformation or breaking when the bag is grasped by the user's hand as illustrated at 216. We have tried breakfast cereal, Styrofoam filling material of 3×2×1.5 cm size, and broken coral pieces of size less than 3 mm. The use of material filled bags is analogous to the sandbags used by traditional Foley artists (a Foley artist, named after pioneer Jack Foley, creates or adds sound effects/noises such as footsteps, kisses, punches, storm noises, slamming doors, etc. to the film soundtrack, often using props that mimic the action.) Through the use of grabbing gestures, a sound effects artist can use the pouch seen in FIG. 2 to simulate the sound of foot-steps and the material used in the bag defines the property of the material that is being stepped on (for example cornflakes for leaves and cornstarch for snow {Ref. 4}.

So far, we have experimented with filling materials such as cornflakes and ground coral (in plastic and cloth lining bags), Styrofoam beads, and a metallic chain, each yielding a very different set of dynamic control parameters. A plastic bag creates a sound that in part results from the bag itself, whereas a cloth bag produces a more muffled sound. Haptic components of the interaction can still be felt through the bag. For example the breaking of cereal or the shifting of coral sand will be felt by the person deforming the bag, and feeling produced by the materials resistance to deformation is maintained.

The sound signal picked up by the microphone 25 and passed to the personal computer 24 via the sound card 211 is processed as described below in the section entitled "Grainification." After processing, the resulting signal is used to create an output sound signal supplied to a loudspeaker 220.

The ScrubberGlove

The third pickup implementation is shown in FIG. 3 and uses a microphone 305 mounted in a glove indicated generally at 310. to make detect sonic events related to tactile signals. One or more fingertips have been removed to expose the wearer's fingertips as illustrated at 315 to provide the wearer with an immediate tactile sensation. Other covered tips of the glove can be padded with various roughly textured material patches as illustrated by the patch 312 on the thumb portion of the glove. Alternatively, the glove itself may be made of a roughly textured material designed to create scrapping or crumpling sound as the wearer handles and feels an object. A microphone like the microphone 305 may be positioned at each fingertip and each microphone may be positioned adjacent to a textured patch constructed of a different material, thereby tending to produce different sounds as different portions of the glove are brought into contact with the object being manipulated. Each microphone is connected to a wireless transmitter seen at 317 which sends an RF signal to a wireless receiver 318 that supplies the detected audio signal or signals from the microphone or microphones to a sound card 331 in a personal computer 333. The wearer can use the glove to freely interact with the environment and create sound expressions while experiencing the usual haptic feel of objects handled with the gloved hand.

The sound signal picked up by the microphone 305 may be supplied to the PC 333 using a wireless connection as shown in FIG. 3 which provides greater freedom of movement to the wearer. The received sound signal is processed by the PC 333 as described below and the resulting signal is used to create an output sound signal supplied to a loudspeaker 340.

Grainification Process

To use the raw audio signal produced by the microphones in the three embodiments to indicate the timing and nature of each grain (short sound burst) that is a component of the output sound formed by granular synthesis, the signal stream from the microphone(s) needs to be analyzed for granular events.

Live audio based sound manipulation is a known concept. It has for instance been used by Jehan, Machover and coworkers {Refs. 10, 11}, although in their case the relationship between audio event and haptic action was not explicitly retained, as the audio was driven by an ensemble mix of traditional acoustical musical instruments as opposed to employing a mechanism for creating granular sound events (e.g. pebbles colliding, cornflakes breaking, or scratching with textured fabric) in the first instance, and then using a signal processing technique for capturing these object-generated granular events.

Granular processing is usually related to what Lippe called "Granular Sampling" {Ref. 13} but can also be Wavelet inspired processing {Ref. 21, see for a review}. Neither of these processing paradigms adequately captures the properties we require for intimate interactive control and hence we draw from music, speech and sound retrieval literature for ideas to arrive at practical real-time "granular analysis" algorithms that allow for the grain-level control, that we are looking for. This procedure differs from simple granular sampling and we will call it "grainification." Grainification is similar to event detection as described by Puckette {Ref. 20} and is specifically adapted to identify the kind of events that are of importance when processing the signals representative of object collisions produced by the microphones used in the PebbleBox, CrumbleBag and ScrubberGlove embodiments described above.

Events to be detected should have an amplitude and a duration sufficient to be within the temporal range of perception (that is, the event should be of at least a predetermined minimum amplitude and have a duration greater than 0.5 to 1.0 seconds). The amplitude and a measure of the spectral content should then be extracted from each detected event.

The grainificaton procedure is constrained by the need to detect each grain in real time. The need to insure that events have a predetermined minimum duration suggests that there must be some delay between the onset of the event and the point in time when it is determined to have the prescribed minimum duration. In addition, the need to extract amplitude and spectral content information during its duration also implies the need to buffer the content of the incoming signal for a time.

Figure 4:
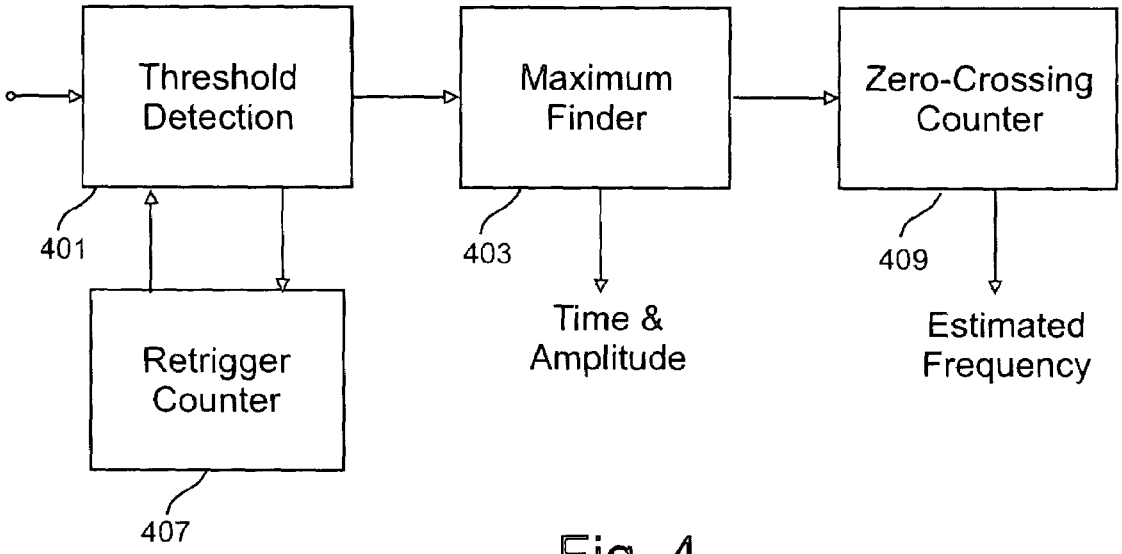
FIG. 4 is a block diagram illustrating the manner in which the signal from the microphones in the arrangements seen in FIGS. 1-3 is preferably processed to create event signals.
Figure 5:
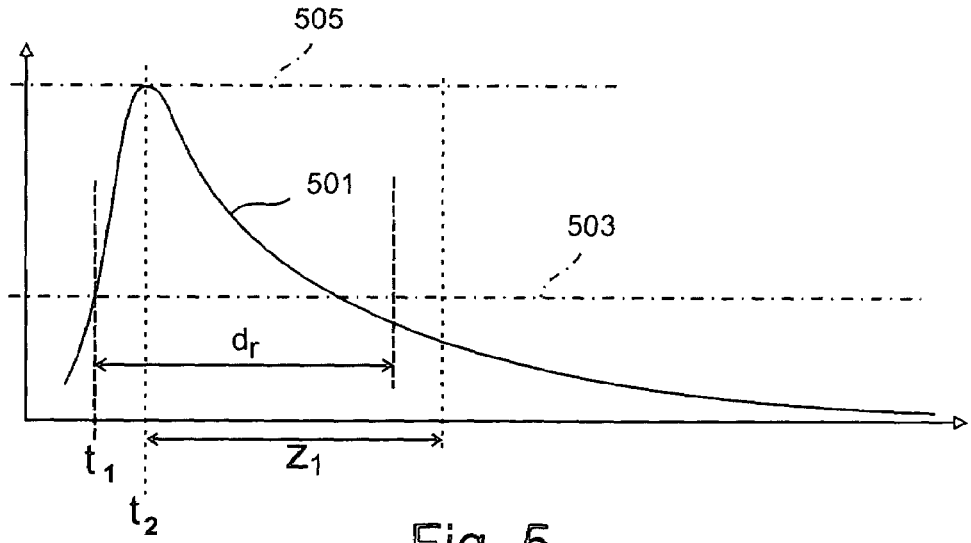
FIG. 5 depicts a representative signal created by a microphone and illustrates the manner in which that signal is processed by the components seen in FIG. 4.

Given these constraints we employ the Grainification procedure which is illustrated in FIGS. 4 and 5.

The onset of a grain (event) is detected by detecting when the input signal from the microphone, depicted by the curve 501 in FIG. 5, is increasing and passes through a threshold level seen at 503 at time t1. The threshold detection occurs at 401 in FIG. 4 which provides a signal at time t1 to the maximum finder 403 which tracks the signal 501 after the threshold level 503 is crossed and detects the time t2 at which the signal 503 reaches the first maximum after time t1. It may be noted that no attempt is made to average the envelope signal 501 because it is assumed that events will have impulsive onsets that will end when the event signal reaches its strongest maximum. The amplitude of this first maximum indicated at 505 is saved as indicated at 403 in FIG. 4. The maximum finder 403 delivers both the value of the maximum amplitude 505 as an immediate measure of grain strength, and the timing t2 at which this maximum occurred.

After a grain event is detected, no attempt to detect the next event should be attempted until a predetermined time has expired (a duration called the retriggering delay dr indicated at 507 in FIG. 5). In this way, the Grainification process detects only those events that lie in the temporal range of perception; that is events which are separated in time by a time duration greater than 0.05-0.1 seconds, or expressed another way, by events that occur at a frequency that is less than 10-20 Hz. The retrigger counter seen at 407 in FIG. 4 counts timing pulses from a clock until a predetermined count is reached indicating that the retrigger delay interval dr has elapsed, signaling the threshold circuit 401 to again look for an increase in input signal level that passes through the threshold 503. By suppressing the detection of new events during the retrigger delay, spurious re-triggering by the decaying oscillation of the detected grain is prevented by waiting until the grain has decayed below the detection threshold 503.

The Grainification process also needs to extract an indication of the spectral content of each event. To this end, a zero-crossing counter seen at 409 in FIG. 4 is employed to produce a moving average zero-crossing count. Over a short-time moving window, the number of zero crossings is calculated. This value is used as a spectral measure. The number of zero-crossing is bound from below by the lowest frequency present in a signal {Ref. 5} and has a correspondence overall with the dominant spectral content of a signal (i.e. the spectral centroid described in {Refs. 19, 17}).

The purpose of Grainification is to convert the raw audio signal digitized from the microphone into discrete events. These events are characterized by time, amplitude and spectral content of a collision event. To summarize, the procedure consists of the following steps as depicted in FIGS. 4 and 5:

1) At 401, identify event onset as the input waveform increases to exceed a predetermined trigger threshold 503 as seen at time t1;
2) At 403, identify the time and amplitude of the signal when it reaches the first maximum 505 occurring after the threshold crossing time t1;
3) Record Amplitude 503 and Time t2 when the first maximum occurs;
4) Start retrigger counter 407 to establish the retrigger delay interval dr (the retrigger counter may count digital samples);
5) At 409, concurrently count the zero crossings of the input waveform during a predetermined moving time window (e.g. the number of zero crossings that occur for a fixed number of succeeding digital audio samples, and convert the zero crossing count into a frequency estimate;
6) Wait until retrigger counter 407 reaches (or counts down to) a predetermine count, and then repeat beginning at step 1.

The signal processing method described above is based on the assumptions are detected events will be characterized by a rapid onset, followed by a period of decay which is no longer than the retrigger delay dr. For this reason this procedure would not be meaningful for the class of sustained sounds which would be inherently less suited to the type of temporal pattern that we are trying to extract. However, because the characteristics of the sound events which are manifested in the microphone outputs in the PebbleBox, CrumbleBag and ScrubberGlove embodiments satisfy the foregoing assumptions, the specific event detection mechanism used is well matched to the sound events to be processed. We found, using the foregoing assumptions and the signal processing steps based on these assumptions described above, that reliable grain detection and believable control is achieved, and more complex processing is not required.

Creating Output Sound

The information bearing signals derived from the analysis described above can be used to control arbitrary signals. By way of example, the arrangement shown in FIG. 6 may be employed to translate the event information extracted by Grainification to produce synthesized audio. The timing information is used to instantaneously trigger short sound segments (typically much shorter than 1 second) previously stored, such as pre-recorded environmental sounds such as those resulting from the collision of different kinds of objects, water slushing, etc.

Figure 6:
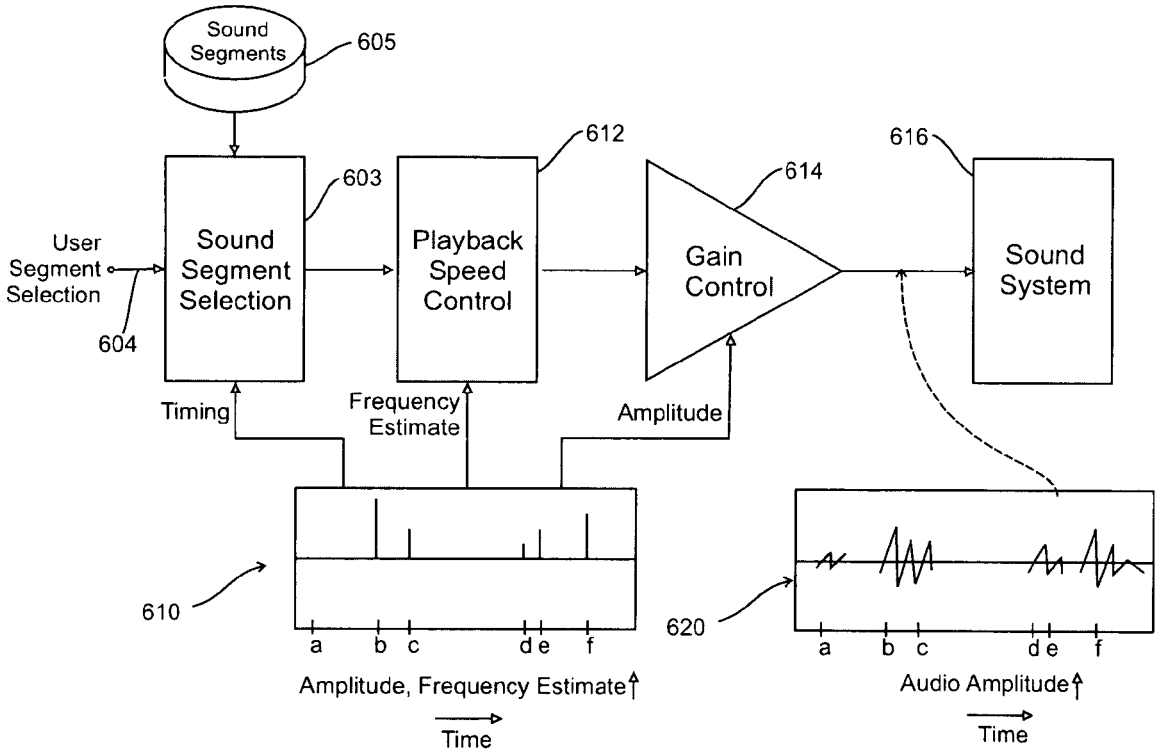
FIG. 6 illustrates how the event signals created as seen in FIGS. 4-5 are processed to produce output sound signals.

Each event signal (defining a time, an amplitude and a frequency estimate) produced by Grainification is used to control timing, amplitude and playback speed of a stored sound segment. The reproduction process is depicted in FIG. 6. First, as indicated at 603, a sound segment to be played back is selected by the user at 604 from a library of pre-recorded sound segments 605 to achieve a desired effect. The selected sound segment is generated at time (relative to other generated sound segments) established by the timing component of an event signal from the sequence of event signals produced by the Grainification process as illustrated at 610 in FIG. 6.

The frequency estimate component of each event signal is used at 612 to control the playback speed and hence the timbre of each output sound segment using the "chipmunk effect."

The amplitude component of each event signal is used applied to control the gain of an output amplifier 614 and hence control the amplitude of each output segment.

The resulting output signal applied to the input of a conventional sound system 616 is the superimposed combination of the individual sound segments as illustrated at 620, with the timing, amplitude and timbre of each sound segment being individually controlled to correspond to the detected timing, amplitude and timbre of the detected object collision sound signals picked up by the microphone(s) described in connection with the example embodiments shown in FIGS. 1-3.

The mapping of individual events to output sound segments has been the subject of both theoretical and experimental advances as seen, for example, in {Refs. 8, 9 and 23}. We have successfully used the controller mechanism described above to implement two types of granular synthesis. The first was based on recorded dictionaries of environmental sounds and the second used parametric physically informed models developed by Perry Cook {Refs. 1, 2, 3}.

Recorded Environmental Sound Grains

We implemented a prototype grain dictionary based on recordings of natural sounds. Thirty grains were explored using between one and 12 recordings of comparable events. More recordings were used when similar interactions led to different sonic experiences, as for example water splashing or the buckling of a can, or where the detail of the interaction is hard to control and hence leads to variation as in the case of walking, or the shuffling of coins.

The grains are played back based on the granular parameters in the Grainification process. The onset time triggers a variable playback event with the playback amplitude defined by the grain onset amplitude. The playback rate, as a measure of the grains overall frequency, was varied with the average zero crossing at the instance of onset. In the absence of the last procedure, the sound is repetitive and multiple entries in the dictionary of similar grain instances are necessary. Three grains are found to be still too likely to have consecutive instances of equal sound events, whereas this was improved with 8 grains. In the presence of variable frequency the monotonous appearance of the sound disappears even for only one recorded grain. In the case of multiple grain recordings for one grain event in the dictionary, a particular instance is chosen at random.

Physically Informed Parametric Models

In order to explore parametric models, we used Perry Cook's shaker-based granular synthesis as implemented in his STK software described in {Ref. 3}. Here the mapping of grain onset time and amplitude relates to time and amount of energy infused into the physically inspired model. The zero-crossing average is mapped to the center resonance frequency of the models. These models have inherent stochastic variability. Also some do respond more immediately to energy infusion than others. This does affect the perception of playability, and in general a strong correlation of energy infusion to granular events is desirable. For details on the parametric model synthesis we refer the reader to {Refs. 1, 2 and 3}.

Applications

The PebbleBox, CrumbleBag and ScrubberGlove embodiments may each be used in combination with the object collision event detection and analysis and playback system described above in a variety of useful applications, some of which are listed below as examples:

Toys for Relaxation—The devices can be used as a tabletop relaxation toy. Water sounds and the tactile interactions are reported by a test audience to be soothing.

Musical performance—The devices may be used as musical instruments. Each allows for flexible interactions of particle sounds and is particularly useful for granular synthesis. No similarly commercial instrument for this purpose is currently available.

Interactive Content creation for the movie, broadcast and computer game industries. These devices allow a user to perform complex expressive gestures and provide simple parametric output to describe such gestures. This is important for content creators who need to add expressive sensory content to their otherwise purely visual media. In particular sound effects may be authored flexibly and efficiently, and the CrumbleBag with interchangeable contents was designed with this application in mind.

Medical applications—These devices link hand and arm motor movement to sound events providing a rich tactile and sonic experience. This can be useful in medical therapeutic and rehabilitation settings in which such relations need to be trained or remembered, for example in therapeutic treatment of the hand-shakes of Parkinson patients, the retraining of limb control after neurological damage or fracture rehabilitation.

CONCLUSION

It is to be understood that the methods and apparatus which have been described above are merely illustrative applications of the principles of the invention. Numerous modifications may be made by those skilled in the art without departing from the true spirit and scope of the invention.

What is claimed is:

1. Apparatus for processing sounds produced by manipulating one or more physical objects that can be felt by touch by a human manipulator, said apparatus comprising:

an acoustic transducer for converting said sound into an electrical signal, an event detector for detecting and determining the magnitude and timing of each of a sequence of detected sound signal events manifested by said electrical signal, a timer for disabling said event detector for a predetermined delay interval immediately following the occurrence of each sound signal event, and a controlled signal generator for producing a composite output sound signal which includes an output sound segment corresponding to each given one of said sound signal events, said output sound segment having an intensity and a time of occurrence that corresponds to said amplitude and timing of said given one of said sound signal events.

2. Apparatus for processing sounds produced by manipulating one or more physical objects as set forth in claim 1 wherein said one or more physical objects comprise an aggregation of rigid physical objects that emit said sounds when they collide against one another as they are being manipulated.

3. Apparatus for processing sounds produced by manipulating one or more physical objects as set forth in claim 2 wherein said aggregation of rigid physical objects is retained and supported by a holding container.

4. Apparatus for processing sounds produced by manipulating one or more physical objects as set forth in claim 3 wherein said holding container has an open top providing access to said objects for manipulation by said human manipulator and wherein said acoustic transducer is attached to said holding container.

5. Apparatus for processing sounds produced by manipulating one or more physical objects as set forth in claim 4 wherein said holding container is constructed of or has its interior lined with a soft material to minimize the production of sounds that would otherwise be produced by the collision of said rigid objects with said holding container.

6. Apparatus for processing sounds produced by manipulating one or more physical objects as set forth in claim 1 wherein said one or more physical objects comprise a deformable object that emits sounds when grasped and compressed by the hand of a human manipulator.

7. Apparatus for processing sounds produced by manipulating one or more physical objects as set forth in claim 6 wherein said deformable object comprises a flexible bag for holding a material that emits sounds when said bag is deformed.

8. Apparatus for processing sounds produced by manipulating one or more physical objects as set forth in claim 7 wherein said acoustical transducer is a microphone attached to said flexible bag.

9. Apparatus for processing sounds produced by manipulating one or more physical objects as set forth in claim 8 wherein the contents of said flexible bag can be removed and replaced with a different material which produced sounds of a different character when said flexible bag is deformed.

10. Apparatus for processing sounds produced by manipulating one or more physical objects as set forth in claim 1 wherein an acoustic transducer is attached to a glove that is worn on the hand of said human manipulator to capture sounds produced when said one or more physical objects are manipulated using said glove.

11. Apparatus for processing sounds produced by manipulating one or more physical objects as set forth in claim 10 wherein said glove includes cutaway portions on or near at least some of the fingertips of said hand to permit said one or more physical objects be more easily felt by said human manipulator.

12. Apparatus for processing sounds produced by manipulating one or more physical objects as set forth in claim 11 wherein at least a portion of the exterior surface of said glove that comes into contact with said one or more physical objects consists of a textured surface that emits sounds when brought into contact with said one or more physical objects.

13. Apparatus for processing sounds produced by manipulating one or more physical objects as set forth in claim 1 wherein each of said sound signal events occurs when the magnitude of said electrical signal increases to a maximum value after exceeding a predetermine threshold level and wherein said magnitude is said maximum value and said timing is the timing of the occurrence of said maximum value.

14. Apparatus for processing sounds produced by manipulating one or more physical objects as set forth in claim 13 wherein each of said detected sound signal events has least a predetermined minimum amplitude and wherein consecutive detected sound signal events in said sequence are separated in time from one another by said predetermined delay interval to insure that each of said detected sound signal events is within the temporal range of perception of said human manipulator.

15. Apparatus for processing sounds produced by manipulating one or more physical objects as set forth in claim 14 wherein said predetermined delay interval has a duration in the range between 0.05-0.1 seconds.

16. Apparatus for processing sounds produced by manipulating one or more physical objects as set forth in claim 1 wherein the duration of said predetermined delay interval is greater than 0.05 seconds to insure that each of said detected sound signal events may be individually perceived by the human ear.

17. Apparatus for processing sounds produced by manipulating one or more physical objects as set forth in claim 1 further comprising a sound signal event analyzer for producing, for each given one of said sound signal events detected by said event detector, event information comprising:

timing information indicating the time of occurrence of said given one of said sound signal events, amplitude information indicating the amplitude of said given one of said sound signal events, and frequency estimate information indicating the spectral content of said given one of said sound signal events, wherein said controlled signal generator comprises:

a sound segment generator responsive to said timing information for producing said output segment corresponding to each given one of sound signal at a time specified by said timing information, a gain controller for controlling the amplitude of each given one of said sound segments in response to said amplitude information indicating the amplitude of the corresponding one of said signal events, and means for selecting the timbre of each given one of said sound segments in response to said frequency estimate information indicating the spectral content of the corresponding one of said sound signal events.

18. Apparatus for processing sounds produced by manipulating one or more physical objects as set forth in claim 17 wherein said sound segment generator comprises a source of one or more pre-recorded sounds and a playback unit for reproducing one of said pre-recorded sounds at a time specified by said timing information.

19. Apparatus for processing sounds produced by manipulating one or more physical objects as set forth in claim 18 wherein said means for selecting the timbre of each given one of said sound segments comprises a speed control responsive to said frequency estimate information for varying the playback speed at which said playback unit reproduces said one of said pre-recorded sounds.

20. Apparatus for processing sounds produced by manipulating one or more physical objects as set forth in claim 17 wherein said sound signal event analyzer includes a zero crossing counter for producing said frequency estimate information indicating the spectral content of said given one of said sound signal events.

* * * * *